US010081982B2

(12) United States Patent
Agarwal et al.

(10) Patent No.: US 10,081,982 B2
(45) Date of Patent: Sep. 25, 2018

(54) TORQUE TRANSFER MECHANISM FOR DOWNHOLE DRILLING TOOLS

(71) Applicant: Halliburton Energy Services, Inc., Houston, TX (US)

(72) Inventors: Puneet Agarwal, Pune (IN); Rahul R. Gaikwad, Pune (IN); Bhargav Gajji, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 509 days.

(21) Appl. No.: 14/437,090

(22) PCT Filed: Oct. 25, 2012

(86) PCT No.: PCT/US2012/061789
§ 371 (c)(1),
(2) Date: Apr. 20, 2015

(87) PCT Pub. No.: WO2014/065797
PCT Pub. Date: May 1, 2014

(65) Prior Publication Data

US 2015/0275581 A1 Oct. 1, 2015

(51) Int. Cl.
*E21B 4/02* (2006.01)
*F16D 41/18* (2006.01)
(Continued)

(52) U.S. Cl.
CPC ..... *E21B 4/00* (2013.01); *E21B 4/02* (2013.01); *E21B 7/00* (2013.01)

(58) Field of Classification Search
CPC ..... F16D 41/125; F16D 41/18; F16D 41/185; E21B 4/02
See application file for complete search history.

(56) References Cited

U.S. PATENT DOCUMENTS 3,952,816 A 4/1976 Takano et al.
3,990,550 A * 11/1976 Recker ..... F16D 1/116 192/46
(Continued)

FOREIGN PATENT DOCUMENTS

CN 2077481 U 5/1991
CN 1057882 A 1/1992
(Continued)

OTHER PUBLICATIONS

Chinese Office Action Issued in Corresponding Application No. 201280076297.9, dated Aug. 9, 2016 (17 pages).
(Continued)

*Primary Examiner* — Kipp C Wallace
(74) *Attorney, Agent, or Firm* — Chamberlain Hrdlicka

(57) ABSTRACT

A well tool drilling tool can include a torque transfer mechanism with an inner mandrel, an outer housing, and at least one pawl which displaces radially and thereby selectively permits and prevents relative rotation between the inner mandrel and the outer housing. A drill string can include a drill bit, a drilling motor, and a torque transfer mechanism which permits rotation of the drill bit in only one direction relative to the drilling motor, the torque transfer mechanism including at least one pawl which displaces linearly and thereby prevents rotation of the drill bit in an opposite direction relative to the drilling motor.

28 Claims, 9 Drawing Sheets

(51) Int. Cl.
*E21B 4/00* (2006.01)
*E21B 7/00* (2006.01)

(56) References Cited

U.S. PATENT DOCUMENTS 4,427,079 A 1/1984 Walter
4,811,785 A 3/1989 Weber
5,350,242 A * 9/1994 Wenzel ..... F16D 41/066 175/107
5,450,914 A * 9/1995 Coram ..... E21B 7/06 175/113
5,735,357 A * 4/1998 Palm ..... E21B 7/067 175/61
5,918,715 A * 7/1999 Ruth ..... F16D 41/12 192/46
6,338,403 B1 * 1/2002 Costin ..... F16D 41/12 192/107 T
6,409,000 B1 * 6/2002 Itoh ..... B60K 17/26 180/247
8,459,379 B2 * 6/2013 Sui ..... E21B 4/003 175/371
2002/0056602 A1 * 5/2002 Aurora ..... F16D 41/063 192/45.1
2008/0264692 A1 10/2008 Underwood et al.
2010/0018812 A1 * 1/2010 Louis ..... F16D 65/60 188/71.2

FOREIGN PATENT DOCUMENTS

EP 0870945 10/1998
EP 870945 A1 10/1998
EP 1072809 1/2001
EP 2436944 4/2012
WO 2010030272 3/2010

OTHER PUBLICATIONS

Chinese Office Action Issued in Corresponding Application No. 201280076297.9, dated Dec. 17, 2015 (11 Pages).
International Search Report and Written Opinion issued in corresponding application PCT/US2012/061789, dated Apr. 26, 2013, 2 pgs.
Extended European Search Report Issued in European Appln. No. 12887181.1 (PCT/US2012061789) dated May 12, 2016 (7 pages).

* cited by examiner

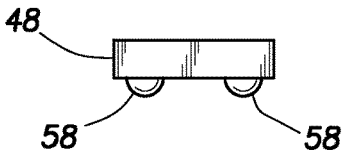
FIG. 10
FIG. 11
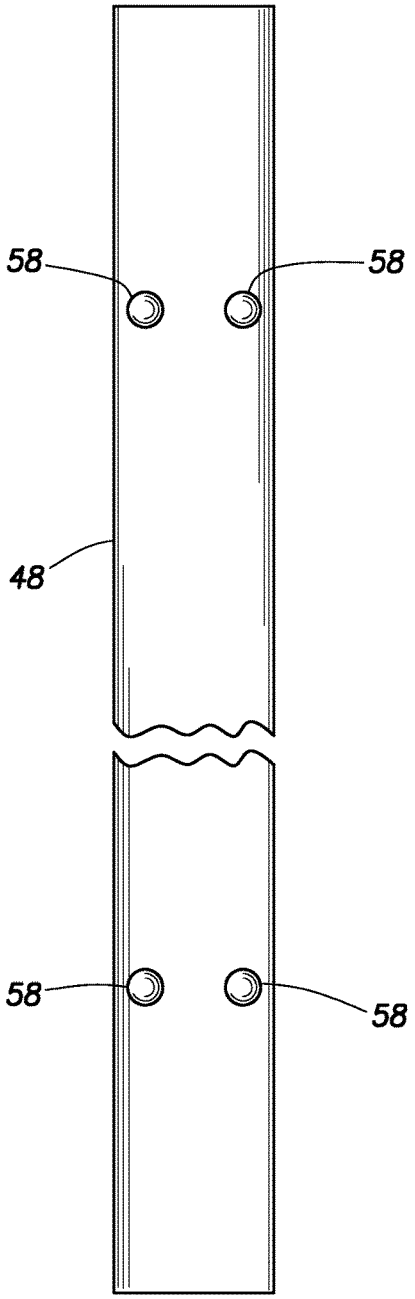

TORQUE TRANSFER MECHANISM FOR DOWNHOLE DRILLING TOOLS

TECHNICAL FIELD

This disclosure relates generally to equipment utilized and operations performed in conjunction with a subterranean well and, in one example described below, more particularly provides a torque transfer mechanism for downhole drilling tools.

BACKGROUND

When drilling in rotary mode, with rotation of a drill string being used to rotate a drill bit, and with a positive displacement drilling motor in the drill string, the drill bit will generally rotate at a greater speed than the drill string. This is because the drilling motor rotates the drill bit, and the drill string above the drilling motor rotates the drilling motor.

Unfortunately, as weight on the bit increases, and/or as torque increases (e.g., due to encountering a harder subterranean formation, etc.), the rotational speed of the bit can decrease to a point where the drill string above the drilling motor rotates at a greater speed than the bit. This situation can cause damage to the drilling motor and/or other drilling equipment in the drill string.

Therefore, it will be appreciated that improvements are continually needed in the art of constructing and operating downhole drilling tools. Such improvements may be used in the situation discussed above, or in other drilling situations.

BRIEF DESCRIPTION OF THE DRAWINGS

FIGS. 10 & 11 are representative end and elevational views of a linear bearing of the torque transfer mechanism.

DETAILED DESCRIPTION

Figure 1:
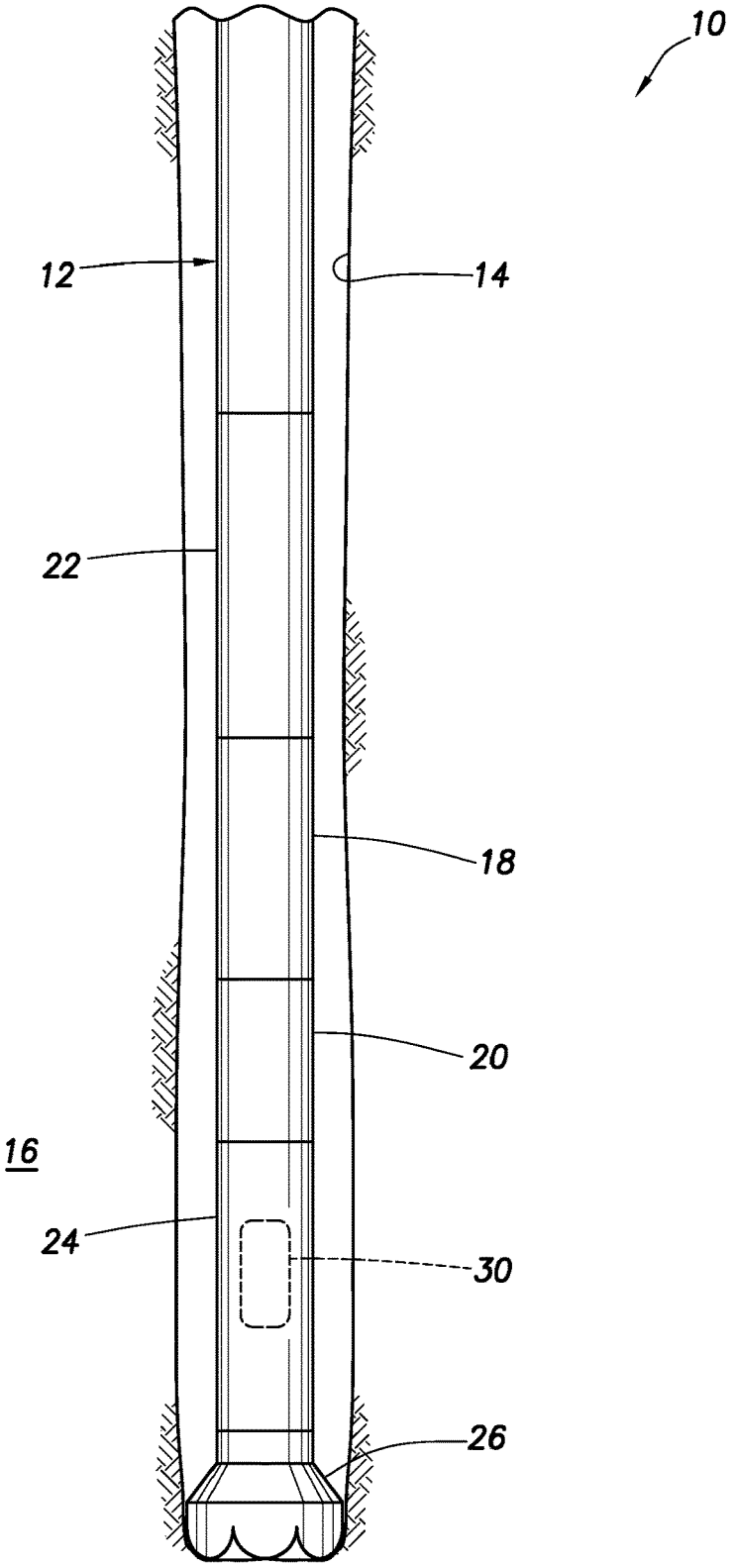
FIG. 1 is a representative partially cross-sectional view of a well drilling system and associated method which can embody principles of this disclosure.

Representatively illustrated in FIG. 1 is a system 10 for drilling a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a drill string 12 is being used to drill a wellbore 14 in an earth formation 16. The wellbore 14 may extend in any direction, and the drill string 12 could be any type of drill string (e.g., drill pipe, coiled tubing, made of composite materials, wired or "intelligent" conduit, etc.). The scope of this disclosure is not limited to any particular type of drilling operation or drill string.

A drilling motor 18 is interconnected in the drill string 12. In this example, the drilling motor 18 can be a positive displacement motor which produces a desired rotational speed and torque for well drilling operations. A Moineau-type progressive cavity "mud" pump of the type well known to those skilled in the art may be used for the drilling motor.

A bearing assembly 20 transmits the rotational output of the motor 18 to a drill bit 26 connected at a distal end of the drill string 12. In this example, the bearing assembly rotationally supports an output shaft 34 (not visible in FIG. 1, see FIG. 2) of the drilling motor 18. In other examples, the bearing assembly 20 could be integrated with the drilling motor 18, or the bearing assembly could be otherwise positioned.

A measurement-while-drilling (MWD) and/or logging-while-drilling (LWD) system 22 can be used for measuring certain downhole parameters, and for communicating with a remote location (such as, a land or water-based drilling rig, a subsea facility, etc.). Such communication may be by any means, for example, wired or wireless telemetry, optical fibers, acoustic pulses, pressure pulses, electromagnetic waves, etc.

Although the drill string 12 is described herein as including certain components, it should be clearly understood that the scope of this disclosure is not limited to any particular combination or arrangement of components, and more or less components may be used, as suitable for particular circumstances. The drill string 12 is merely one example of a drill string which can benefit from the principles described herein.

During drilling operations, a drilling fluid is circulated through the drill string 12. This fluid flow performs several functions, such as cooling and lubricating the bit 26, suspending cuttings, well pressure control, etc.

In the FIG. 1 example, the fluid flow also causes the drilling motor 18 to rotate the bit 26. If the drill string 12 above the motor 18 is also rotated (e.g., by a rotary table, a top drive, another drilling motor, etc.), a result can be that the bit 26 rotates at a greater rotational speed as compared to the drill string above the motor. This is typically a desirable situation.

If, however, weight applied to the bit 26 is increased, then the rotational speed of the bit can decrease, due to an increased torque being needed to continue rotating with the increased applied weight. Similarly, if a harder formation is encountered, reactive torque applied via the bit 26 to the motor 18 will increase, thereby slowing the rotational speed of the bit.

Eventually, the rotational speed of the bit 26 can decrease to a point at which it no longer rotates faster than the drill string 12 above the motor 18. At this point, the motor 18 is said to be "stalled," since it no longer produces rotation of the bit 26.

If the slowing of the bit 26 continues, a situation can occur where the bit 26 actually rotates slower than the drill string 12 above the motor 18. If the motor 18 is a positive displacement motor, this can result in the motor becoming like a pump, which attempts to pump the drilling fluid upward through the drill string 12.

This can damage the motor 18 and other drilling equipment, and is to be avoided. If such motor stalling and potential damage can be avoided, this will allow for more continuous drilling, reducing the number of trips of the drill string 12 into and out of the wellbore 14.

The drill string 12 benefits from the principles of this disclosure, in that it includes a well tool 24 with a torque transfer mechanism 30 that prevents such reverse rotation of the bit 26 relative to the motor 18. The well tool 24 and mechanism 30 are depicted in FIG. 1 as being connected between the bearing assembly 20 and the bit 26, but in other examples these components could be otherwise positioned or arranged, other components could be included, various of the components could be integrated with each other, etc.

Figure 2:
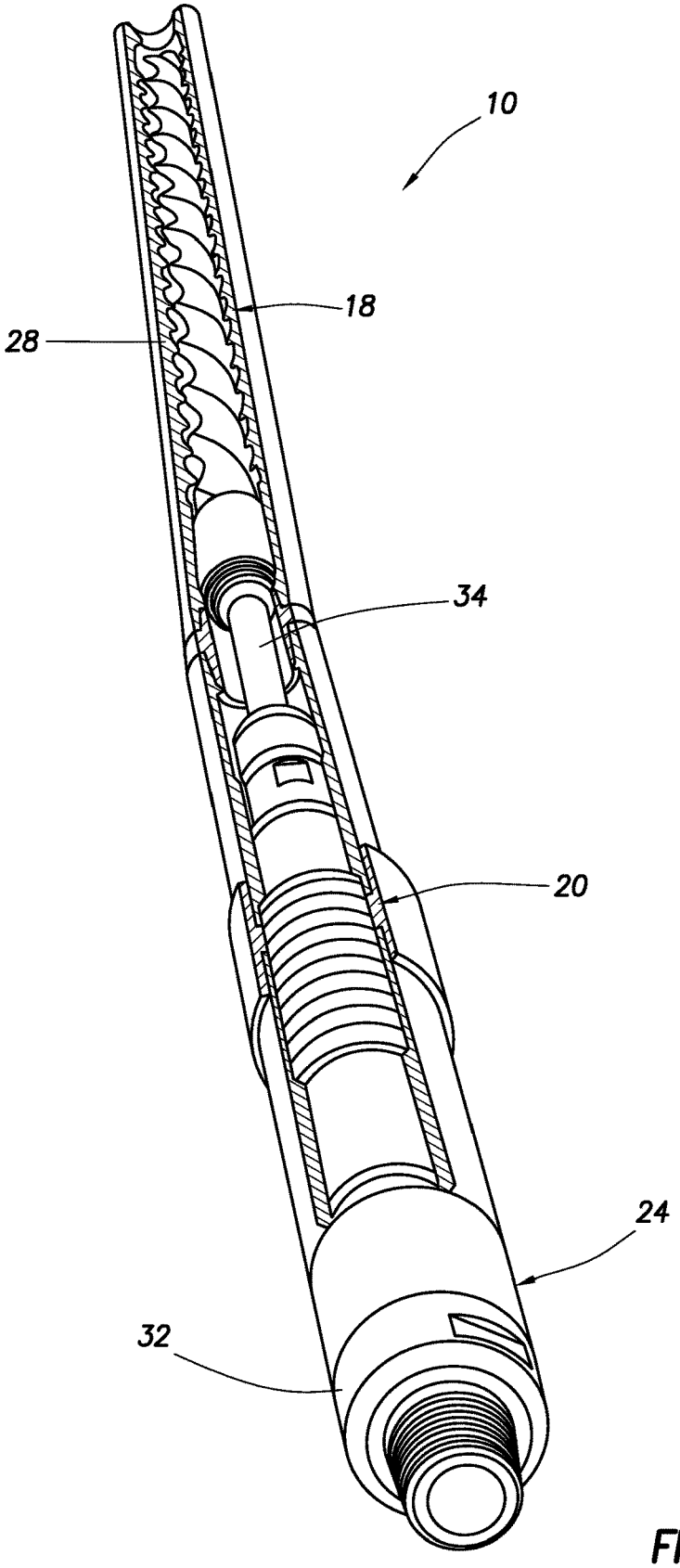
FIG. 2 is a representative partially cross-sectional view of a portion of a drill string which may be used in the system and method of FIG. 1, and which can embody principles of this disclosure.

Referring additionally now to FIG. 2, the drilling motor 18, bearing assembly 20 and well tool 24 are representatively illustrated apart from the remainder of the drill string 12. In this example, the drilling motor 18 includes a power section 28 with a rotor contained in a stator, whereby fluid flow through the power section causes the rotor to rotate relative to the stator.

The rotor is connected to an output shaft 34, which in this example includes a flexible shaft and constant velocity (CV) joints for transferring the rotor rotation via the bearing assembly 20 to a bit connector 32. In this example, the well tool 24 is connected between the bearing assembly 20 and the bit connector 32, with the shaft 34 extending through the well tool 24 from the power section 28 to the bit connector.

The drilling motor 18 in this example is similar in most respects to a SPERRYDRILL™ positive displacement drilling motor marketed by Halliburton Energy Services, Inc. of Houston, Tex. USA. However, other types of drilling motors (e.g., other positive displacement motors, turbine motors, etc.) may be used in other examples.

Figure 3:
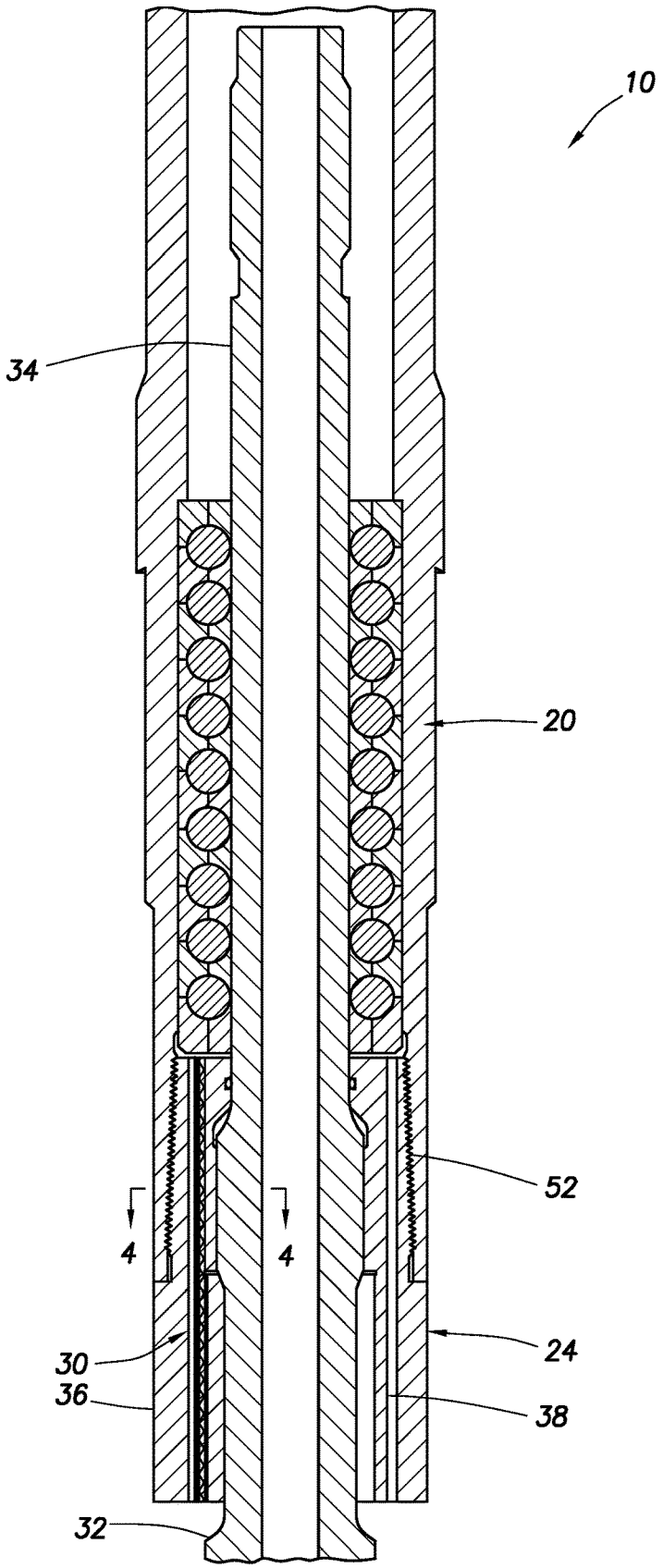
FIG. 3 is a representative cross-sectional view of a torque transfer mechanism which may be used in the drill string, and which can embody principles of this disclosure.

Referring additionally now to FIG. 3, an example of the bearing assembly 20 and tool 24 is representatively illustrated in an enlarged scale cross-sectional view. In this view, it may be seen that the shaft 34 is rotationally supported by the bearing assembly 20, with the shaft extending through the bearing assembly and the tool 24 to the bit connector 32.

The tool 24 desirably permits rotation of the shaft 34 in one direction, but prevents rotation of the shaft in an opposite direction. In this manner, torque can be transferred from the drilling motor 18 to the bit 26 via the shaft 34, but reactive torque in an opposite direction, which could cause reverse rotation of the bit relative to the drilling motor, is not transferred through the tool 24 via the shaft.

Figure 4:
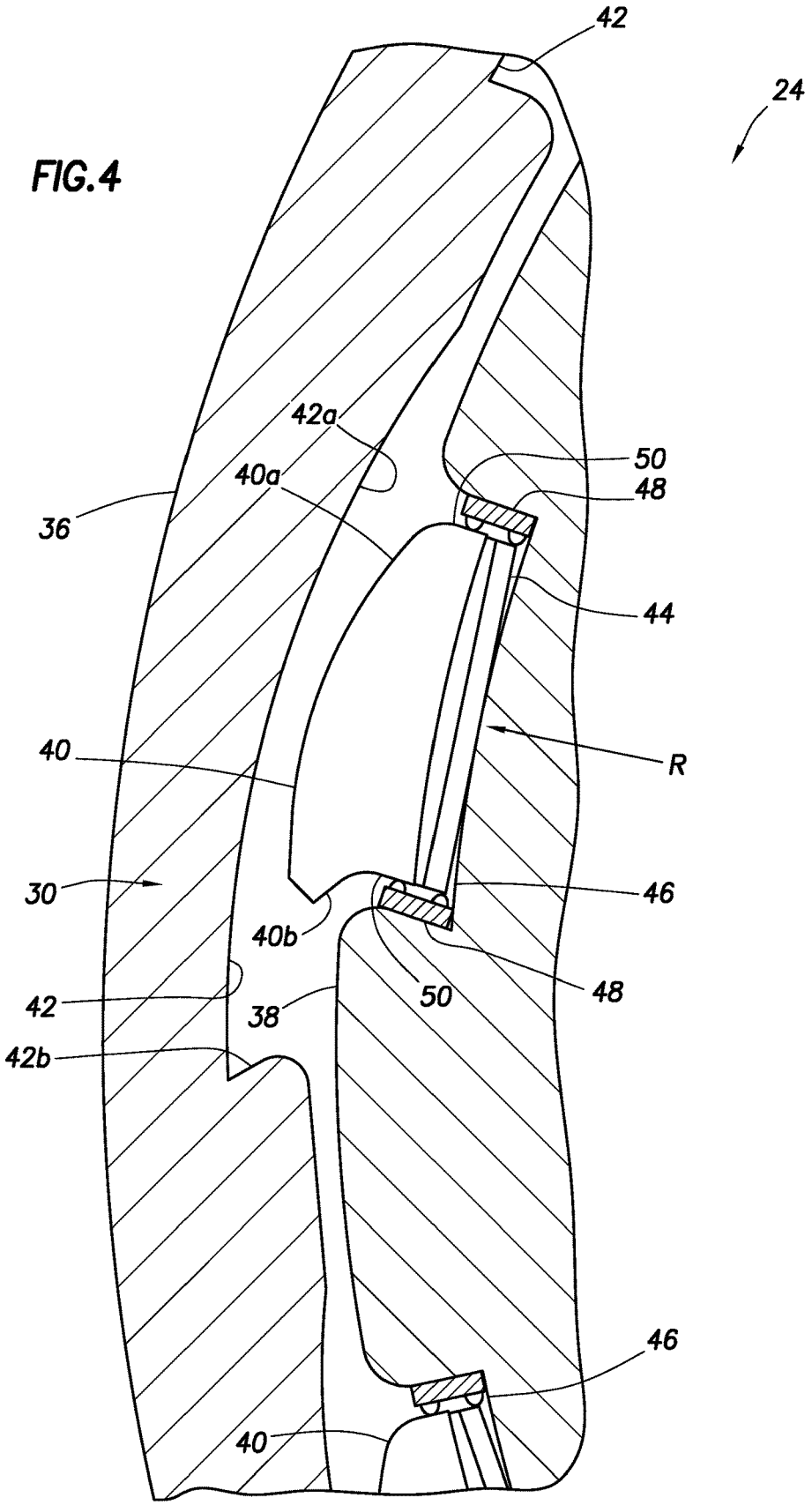
FIG. 4 is a representative cross-sectional view of a portion of the torque transfer mechanism.

A further enlarged scale cross-sectional view of a portion of the tool 24 is representatively illustrated in FIG. 4. In this view it may be seen that the torque transfer mechanism 30 includes an outer housing 36, an inner mandrel 38 and multiple pawls 40 which can engage respective longitudinally extending engagement profiles 42 formed in the outer housing.

In this example, the pawls 40 extend outwardly from the inner mandrel 38 into engagement with the profiles 42 when the inner mandrel rotates counter-clockwise relative to the outer housing 36 (or the outer housing rotates clockwise relative to the inner mandrel). In other examples, the pawls 40 could be carried in the outer housing 36 for engagement with the profiles 42 formed on the inner mandrel 38. Thus, it should be understood that the scope of this disclosure is not limited at all to any specific details of the torque transfer mechanism 30 described herein and/or depicted in the drawings.

The pawls 40 are biased radially outward (e.g., in a direction R linearly outward from a center longitudinal axis of the inner mandrel 38) by respective biasing devices 44. When the inner mandrel 38 rotates in a clockwise direction relative to the outer housing 36, curved surfaces 40*a*, 42*a* engage each other, and this engagement urges the pawls 40 further into recesses 46 formed longitudinally on the inner mandrel 38, against the biasing forces exerted by the biasing devices 44. This permits the inner mandrel 38 to rotate in the clockwise direction relative to the outer housing 36.

However, if the inner mandrel 38 begins to rotate in a counter-clockwise direction relative to the outer housing 36, the pawls 40 will be biased into engagement with the profiles 42 by the biasing devices 44. Curved surfaces 40*a,b* on the pawls 40 will engage curved surfaces 42*a,b* of the profiles 42, and thereby prevent such counter-clockwise rotation.

Linear bearings 48 are provided in the recesses 46, so that the linear displacement of the pawls 40 is relatively friction-free. The linear bearings 48 engage opposing parallel sides 50 of the pawls 40, in order to ensure that the displacement of the pawls is linear, without rotation of the pawls relative to the inner mandrel 38.

Referring additionally now to FIGS. 6-12, various components of the torque transfer mechanism 30 are representatively illustrated in more detailed views. However, it should be clearly understood that the scope of this disclosure is not limited to any particular details of the torque transfer mechanism 30 components, or to use of any particular arrangement or combination of components.

Figure 5:
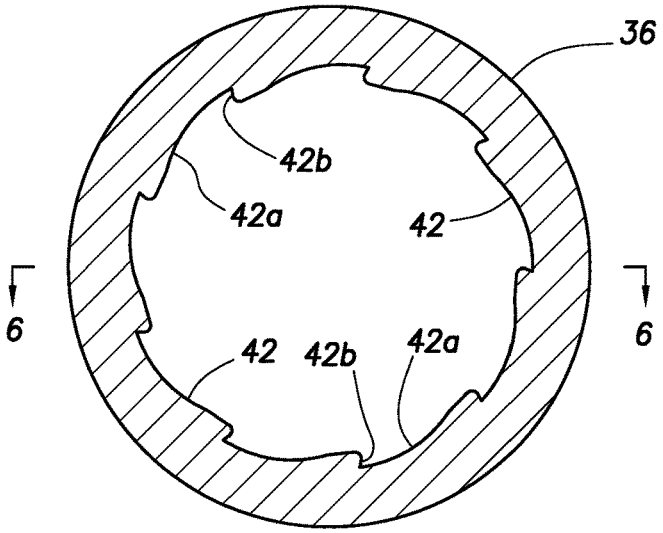
FIGS. 5 & 6 are representative end and cross-sectional views of an outer housing of the torque transfer mechanism.
Figure 6:
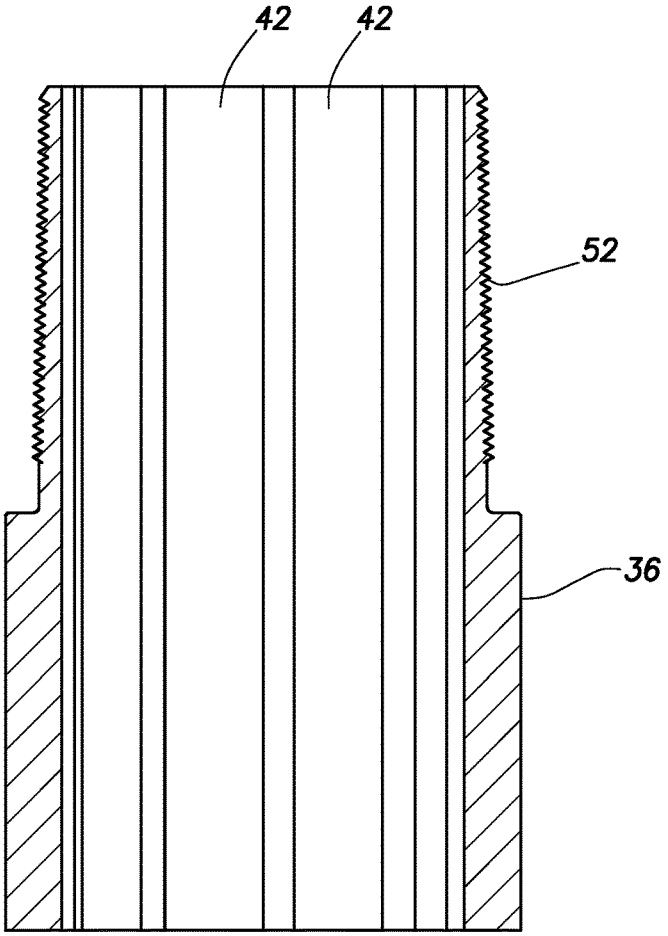

In FIGS. 5 & 6, it may be seen that the outer housing 36 includes an externally threaded upper connector 52 for connecting the torque transfer mechanism 30 to the bearing assembly 20. In other examples, other types of connectors could be used, the outer housing 36 could be part of the bearing assembly 20 or another component of the drill string 12, etc.

Figure 7:
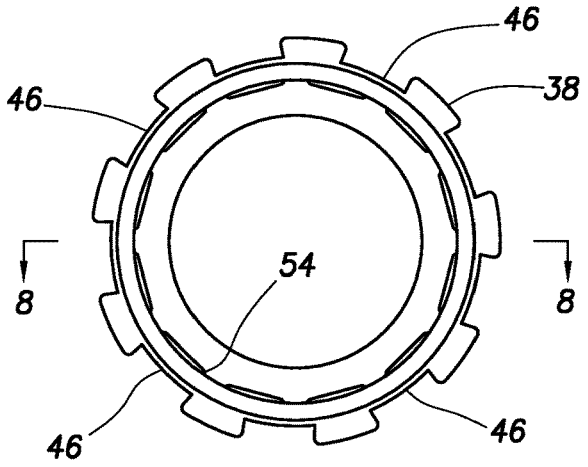
FIGS. 7 & 8 are representative end and cross-sectional views of an inner mandrel of the torque transfer mechanism.
Figure 8:
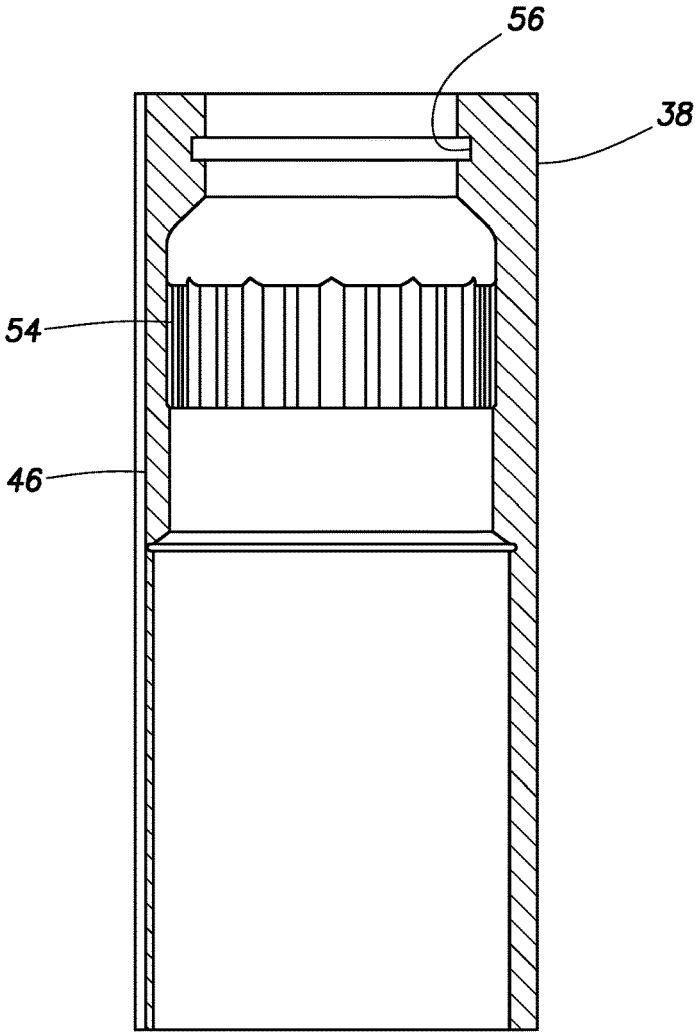

In FIGS. 7 & 8, it may be seen that the inner mandrel 38 includes splines 54 for engaging complementarily shaped splines on the shaft 34, so that the inner mandrel rotates with the shaft. A seal groove 56 is provided for retaining a seal (not shown) to prevent fluid, debris, etc. from passing between the shaft 34 and the inner mandrel 38.

Figure 9:
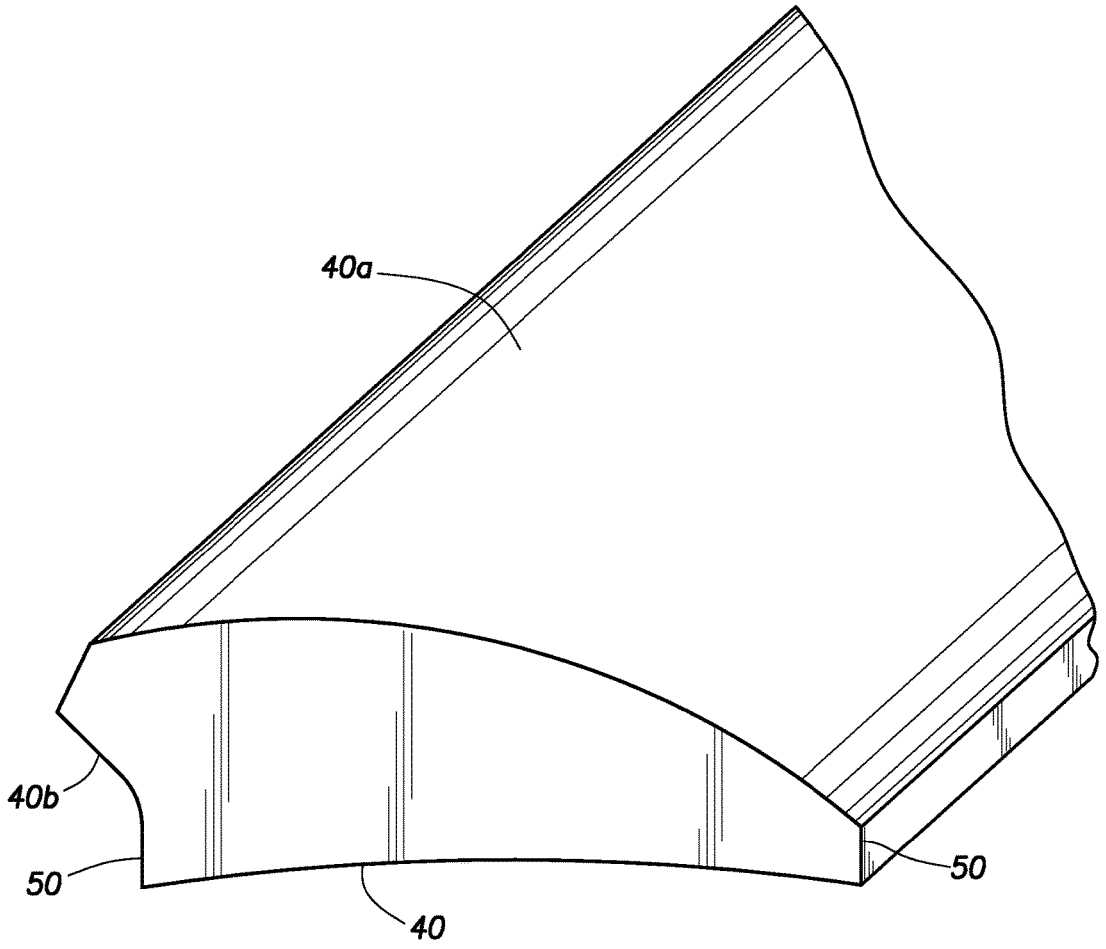
FIG. 9 is a representative perspective view of a pawl of the torque transfer mechanism.

In FIG. 9, an enlarged scale perspective view of one of the pawls 40 is representatively illustrated. In this view, the relationships between the parallel opposite sides 50 and the curved surfaces 40*a,b* may be more clearly seen.

In FIGS. 10 & 11, the linear bearing 48 is representatively illustrated. In this example, the linear bearings 48 include balls 58 for reduced friction engagement with the parallel sides 50 of the pawls 40, but other types of bearings (e.g., roller bearings, plain bearings, etc.) may be used, if desired.

Figure 12:
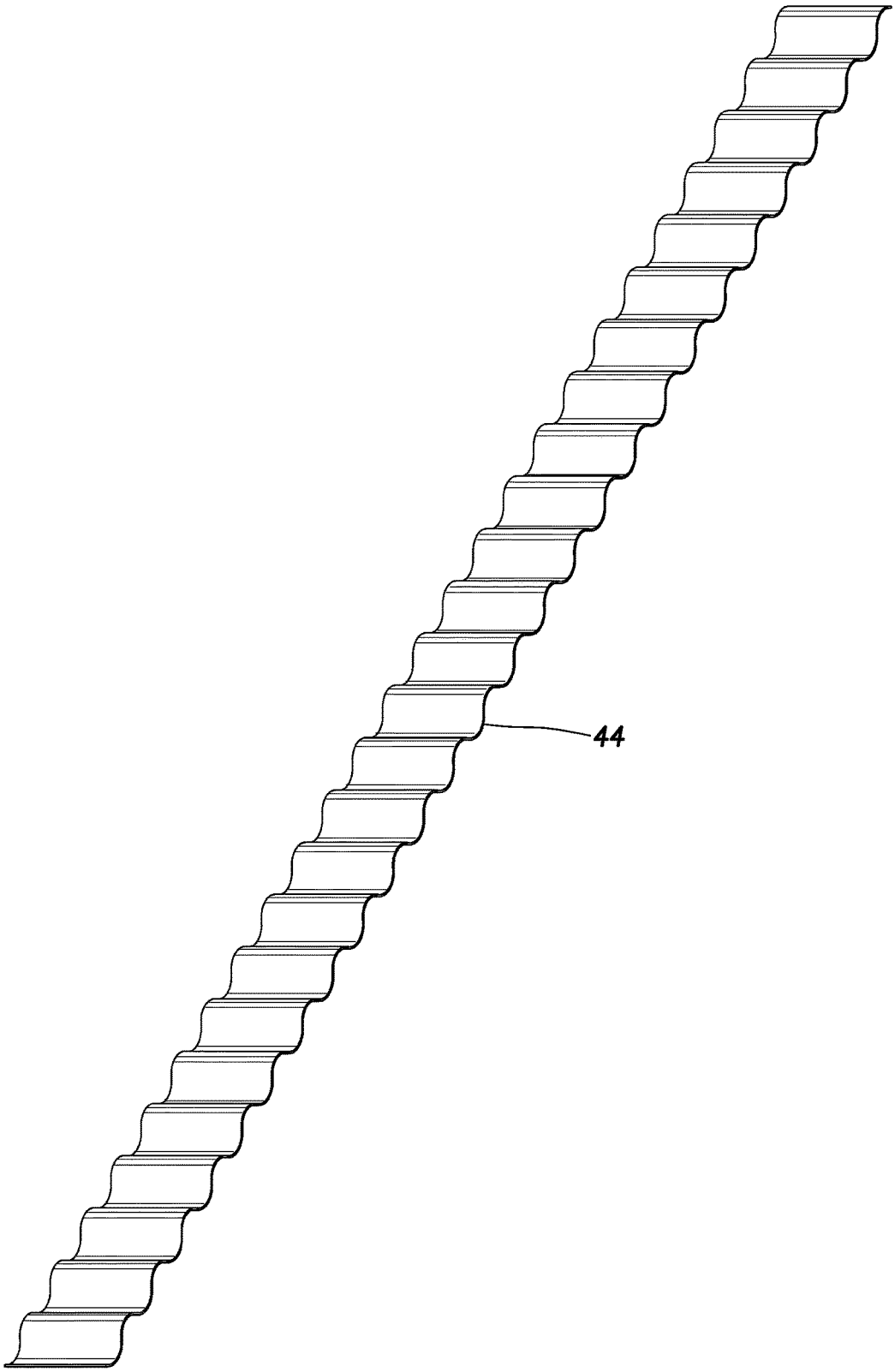
FIG. 12 is a representative perspective view of a biasing device of the torque transfer mechanism.

In FIG. 12, a perspective view of the biasing device 44 is representatively illustrated. In this example, the biasing device 44 comprises a wave spring which, when installed in the torque transfer mechanism 30, extends longitudinally in the recess 46 beneath the pawl 40. However, other types of biasing devices (e.g., leaf springs, coiled springs, etc.) may be used, if desired.

It may now be fully appreciated that the above disclosure provides significant advancements to the art of constructing and operating downhole drilling tools. These advancements can allow for more continuous drilling, reducing the number of trips of the drill string 12 into and out of the wellbore 14.

In examples described above, the torque transfer mechanism 30 prevents reverse rotation of the bit 26 relative to the drilling motor 18. The pawls 40 of the torque transfer mechanism 30 can relatively friction-free displace radially into or out of engagement with the profiles 42.

The above disclosure provides to the art a well tool 24 for use in drilling a subterranean well. In one example, the well tool 24 can include a torque transfer mechanism 30 comprising an inner mandrel 38, an outer housing 36, and at least one pawl 40 which displaces radially and thereby selectively permits and prevents relative rotation between the inner mandrel 38 and the outer housing 36.

Radial displacement of the pawl 40 into engagement with at least one of the outer housing 36 and inner mandrel 38 can permit relative rotation between the outer housing 36 and the inner mandrel 38 in one direction, but prevent relative rotation between the outer housing 36 and the inner mandrel 38 in an opposite direction.

The radial displacement of the pawl 40 may be linear with respect to at least one of the outer housing 36 and the inner mandrel 38.

The pawl 40 can displace radially without rotating relative to at least one of the outer housing 36 and the inner mandrel 38.

The pawl 40 may have opposing substantially parallel sides 50. The mechanism 30 can include linear bearings 48 which engage the pawl sides 50.

The pawl 40 and the linear bearings 48 may be received in a longitudinally extending recess 46 formed on the inner mandrel 38.

The pawl 40 may comprise one or more curved surfaces 40*a,b* which engage(s) one or more curved surfaces 42*a,b* of an engagement profile 42 formed in at least one of the outer housing 36 and the inner mandrel 38.

The well tool 24 can also include a biasing device 44 which biases the pawl 40 in a radial direction. The biasing device 44 may comprise a wave spring which extends longitudinally in a recess 46 formed on the inner mandrel 38.

Also described above is a drill string 12 for use in drilling a subterranean well. In one example, the drill string 12 can comprise a drill bit 26, a drilling motor 18 and a torque transfer mechanism 30 which permits rotation of the drill bit 26 in only one direction relative to the drilling motor 18. The torque transfer mechanism 30 includes at least one pawl 40 which displaces linearly and thereby prevents rotation of the drill bit 26 in an opposite direction relative to the drilling motor 18.

A method of transferring torque between a drilling motor 18 and a drill bit 26 in a well drilling operation is also described above. In one example, the method can include providing a torque transfer mechanism 30 which transfers torque in one direction from the drilling motor 18 to the drill bit 26, but which prevents transfer of torque in an opposite direction from the drill bit 26 to the drilling motor 18; and a pawl 40 of the torque transfer mechanism 30 displacing radially and thereby selectively preventing and permitting relative rotation between an inner mandrel 38 and an outer housing 36 of the torque transfer mechanism 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool for use in drilling a subterranean well, the well tool comprising:

a torque transfer mechanism including an inner mandrel, an outer housing, at least one pawl comprising opposing substantially parallel sides which displaces radially and thereby selectively permits and prevents relative rotation between the inner mandrel and the outer housing, and a plurality of linear bearings received in and coupled to a longitudinally extending recess formed on the inner mandrel or the outer housing, wherein each side of the opposing substantially parallel sides engages with at least one linear bearing of the plurality of linear bearings.

2. The well tool of claim 1, wherein radial displacement of the pawl into engagement with at least one of the outer housing and inner mandrel permits relative rotation between the outer housing and the inner mandrel in one direction, but prevents relative rotation between the outer housing and the inner mandrel in an opposite direction.

3. The well tool of claim 1, wherein the radial displacement of the pawl is linear with respect to at least one of the outer housing and the inner mandrel.

4. The well tool of claim 1, wherein the pawl displaces radially without rotating relative to at least one of the outer housing and the inner mandrel.

5. The well tool of claim 1, wherein the pawl and the linear bearings are received in the longitudinally extending recess formed on the inner mandrel.

6. The well tool of claim 1, wherein the pawl comprises at least one curved surface which engages at least one curved surface of an engagement profile formed in at least one of the outer housing and the inner mandrel.

7. The well tool of claim 1, wherein the pawl comprises multiple curved surfaces which engage multiple curved surfaces of an engagement profile formed in at least one of the outer housing and the inner mandrel.

8. The well tool of claim 1, further comprising a biasing device which biases the pawl in a radial direction.

9. The well tool of claim 8, wherein the biasing device comprises a wave spring which extends longitudinally in the recess formed on the inner mandrel.

10. A drill string for use in drilling a subterranean well, the drill string comprising:

a drill bit; a drilling motor; and a torque transfer mechanism which permits rotation of the drill bit in only one direction relative to the drilling motor, the torque transfer mechanism including;

at least one pawl comprising opposing substantially parallel sides which displaces linearly and thereby prevents rotation of the drill bit in an opposite direction relative to the drilling motor, and a plurality of linear bearings received in and coupled to a longitudinally extending recess formed on an inner mandrel or an outer housing of the torque transfer mechanism, wherein each side of the opposing substantially parallel sides engages with at least one linear bearing of the plurality of linear bearings.

11. The well tool of claim 10 wherein the pawl and the linear hearings are received in the longitudinally extending recess formed on the inner mandrel.

12. The drill string of claim 10, wherein the pawl comprises at least one curved surface which engages at least one curved surface of an engagement profile.

13. The drill string of claim 10, wherein the pawl comprises multiple curved surfaces which engage multiple curved surfaces of an engagement profile formed in at least one of the outer housing and the inner mandrel.

14. The drill string of claim 10, wherein the pawl displaces radially and thereby selectively permits and prevents relative rotation between the inner mandrel and the outer housing.

15. The drill string of claim 14, wherein radial displacement of the pawl into engagement with at least one of the outer housing and the inner mandrel permits relative rotation between the outer housing and the inner mandrel in the one direction, but prevents relative rotation between the outer housing and the inner mandrel in the opposite direction.

16. The drill string of claim 14, wherein the radial displacement of the pawl is linear with respect to at least one of the outer housing and the inner mandrel.

17. The drill string of claim 14, wherein the pawl displaces radially without rotating relative to at least one of the outer housing and the inner mandrel.

18. The drill string of claim 10, further comprising a biasing device which biases the pawl in a radial direction.

19. The drill string of claim 18, wherein the biasing device comprises a wave spring which extends longitudinally in the recess formed on the inner mandrel.

20. A method of transferring torque between a drilling motor and a drill bit in a well drilling operation, the method comprising:

providing a torque transfer mechanism which transfers torque in one direction from the drilling motor to the drill bit, but which prevents transfer of torque in an opposite direction from the drill bit to the drilling motor, the torque transfer mechanism comprising a pawl comprising opposing parallel sides:

engaging each side of the parallel opposing sides with at least one linear bearing of a plurality of linear bearings of the torque transfer mechanism; and the pawl of the torque transfer mechanism displacing radially and thereby selectively preventing and permitting relative rotation between an inner mandrel and an outer housing of the torque transfer mechanism, the plurality of linear bearings being received in and coupled to a longitudinally extending recess formed on the inner mandrel or the outer housing.

21. The method of claim 20, wherein the radially displacing further comprises permitting relative rotation between the outer housing and the inner mandrel in the one direction, but preventing relative rotation between the outer housing and the inner mandrel in the opposite direction.

22. The method of claim 20, wherein the radially displacing further comprises the pawl displacing linearly with respect to at least one of the outer housing and the inner mandrel.

23. The method of claim 20, wherein the radially displacing is performed without the pawl rotating relative to at least one of the outer housing and the inner mandrel.

24. The method of claim 20, wherein the providing further comprises receiving the pawl and the linear bearings in the longitudinally extending recess formed on the inner mandrel.

25. The method of claim 20, wherein the pawl comprises at least one curved surface, and wherein the radially displacing further comprises the pawl curved surface engaging at least one curved side of an engagement profile formed in at least one of the outer housing and the inner mandrel.

26. The method of claim 20, wherein the pawl comprises multiple curved surface, and wherein the radially displacing further comprises the pawl multiple curved surfaces engaging multiple curved surfaces of an engagement profile formed in at least one of the outer housing and the inner mandrel.

27. The method of claim 20, the radially displacing further comprises a biasing device biasing the pawl in a radial direction.

28. The method of claim 27, wherein the biasing device comprises a wave spring which extends longitudinally in the recess formed on the inner mandrel.

* * * * *